United States Patent [19]

Chennels

[11] Patent Number: 4,838,729

[45] Date of Patent: Jun. 13, 1989

[54] SOIL STABILIZING APPARATUS

[76] Inventor: Donald A. Chennels, 308 - 8880 No. 1 Road, Richmond, British Columbia V7C 4C3, Canada

[21] Appl. No.: 270,483

[22] Filed: Nov. 4, 1988

Related U.S. Application Data

[63] Continuation of Ser. No. 118,207, Nov. 6, 1987, abandoned.

[51] Int. Cl.[4] ..... E01C 21/00

[52] U.S. Cl. ..... 404/90; 299/39; 299/79; 299/89

[58] Field of Search ..... 404/90, 91, 92; 299/39, 299/79, 88, 89; 175/410; 125/5; 172/121, 552, 553, 554; 51/206 P, 206 R, 176

[56] References Cited

U.S. PATENT DOCUMENTS

| | | | |
|---|---|---|---|
| 1,614,225 | 1/1927 | Bath | 51/206 P X |
| 2,397,782 | 4/1946 | Flynn | 404/92 X |
| 2,520,066 | 8/1950 | Rush | 299/89 X |
| 2,547,325 | 4/1951 | Johnson | 299/79 X |
| 3,128,755 | 4/1964 | Benson | 51/206 R X |
| 3,292,510 | 12/1966 | Chennells | 404/90 |
| 3,596,577 | 8/1971 | Chennells | 404/90 |
| 3,675,973 | 7/1972 | Mottinger | 299/88 |
| 4,705,017 | 11/1987 | Lewis | 51/206 R X |

FOREIGN PATENT DOCUMENTS 744610 10/1966 Canada .

*Primary Examiner*—Jerome W. Massie, IV
*Assistant Examiner*—Matthew Smith
*Attorney, Agent, or Firm*—Christie, Parker & Hale

[57] ABSTRACT

An apparatus to stabilize a surface. The apparatus includes a carrier arranged for movement over the surface to be stabilized. A reel is mounted on the carrier for rotation about an axis of rotation transverse to the direction of movement of the carrier. The reel has a plurality of circumferentially spaced cutter bars that extend the length of the reel parallel to the axis of rotation. The reel can be lifted and lowered relative to the surface. The trailing face of each cutter bar has an area formed to reduce pressure at the trailing face as the cutter bar rotates.

7 Claims, 2 Drawing Sheets

SOIL STABILIZING APPARATUS

Cross-Reference to Related Applications

This is a continuation of application Ser. No. 07/118,207, filed Nov. 6, 1987, now abandoned.

p FIELD OF THE INVENTION

This invention relates to an apparatus for treating a surface to stabilize that surface.

DESCRIPTION OF THE PRIOR ART

My U.S. Pat. No. 3,596,577 describes and claims a method and an apparatus for soil stabilization in which the soil to be stabilized is shaved and the shavings rubbed against the resultant soil face while a liquid stabilizing additive is applied. The apparatus has a driven wheel having shaving, rubbing elements which continuously first shave the soil to provide a soil face then pulverize the shavings and rub the shavings against the soil face as a liquid stabilizing additive is sprayed onto the pulverized soil to be mixed with the soil as the wheel rotates.

The apparatus in my above United States patent, the disclosure of which is herein incorporated by reference, includes a carrier arrangement to move over the soil to be stabilized and a reel mounted on the carrier for rotation about an axis of rotation transverse to the direction of movement of the carrier. The wheel has a plurality of circumferentially spaced bars extending the length of the reel parallel to the axis of rotation, each bar being square in cross-sections so as to present flat side walls extending from straight transversed corner edges. Each bar is angularly disposed to present an advanced side wall inclined forward from an outer corner edge at an angle between 10 and 15° to a radius line between the axis of rotation of the wheel and the outer corner edge so that the outer corner edge serves ves as a cutting edge for shaving a face with the soil. The advanced side wall rubs soil shavings against the face. The apparatus further includes power lifting means for lifting and lowering the reel relative to the surface of the ground. A sensor to sense vibrations in the reel is provided and there are means, activated by the sensor, to lift the power lifting means to lift the reel away from the soil being stabilized when the vibrations reach a predetermined level.

The apparatus of the above United States Patent includes a spray bar for directing a spray of liquid stabilizing additive towards the reel and the shaved face. The liquid additive is carried in a tank mounted on the carrier and is forced by a pump through conduits connected to a spray bar. The apparatus includes an engine for the liquid pump that also drives the reel through a chain sprocket drive. The equipment is mounted on a carrier that includes wheels, an engine, controls and a seat for a driver.

My U.S. Pat. No. 3,292,510, to which Canadian Patent No. 744,160 corresponds, teaches a road surface stabilizing device that includes at least one road pulverizing reel mounted for rotation transverse of a support structure that can move over a surface. The stabilizing device of the patent includes means to inject stabilizing material onto a road layer that has been pulverized by the reel.

Good results have been achieved with the apparatus of the above United States Patents. In particular the above machines provide good uniformity of additive addition. In roadmaking by spraying asphalt on a surface cut by the bars the machines, especially that of U.S. Pat. No. 3,292,510, are able to provide a good uniformity of distribution of the asphalt throughout the finished road service. The required level of asphalt in these circumstances if 5% and it should be as uniformly distributed as possible. The above machines provide far better than average performance in achieving this uniformity. Asphalt in a road surface formed in this manner gives a stable, lasting surface provided the asphalt is uniformly distributed. However, continuing development work has shown that results can be improved if the bars on the reel of the apparatus of U.S. Pat. No. 3,596,577 are modified to create an area of reduced pressure on the trailing face of the bars. This area of reduced pressure has been found to give a better distribution of the additive compared with the square bar that is required in the patent.

SUMMARY OF THE INVENTION

Accordingly, the present invention is an apparatus for shaving a surface, the apparatus including a carrier arranged for movement over the surface to be stabilized, a reel mounted on the carrier for rotation about an axis of rotation transverse to the direction of movement of the carrier, the reel having a plurality of circumferentially spaced bars that extend the length of the reel parallel to the axis of rotation, lifting means for lifting and lowering the reel relative to the surface the improvement comprising forming the trailing face of each cutter bar with means to produce a zone of reduced pressure at said trailing face as the cutter bar rotates.

In a preferred embodiment the apparatus includes means to apply a stabilizing liquid to the shaved surface.

DESCRIPTION OF THE DRAWINGS

Aspects of the invention are illustrated, merely by way of example, in the accompanying drawings in which.

DESCRIPTION OF THE PREFERRED EMBODIMENTS

Figure 1:
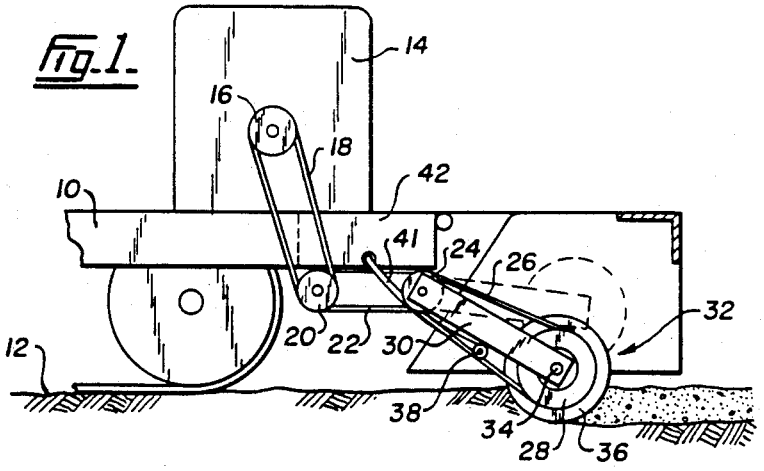
FIG. 1 is a partial view of the apparatus according to the present invention.
Figure 2:
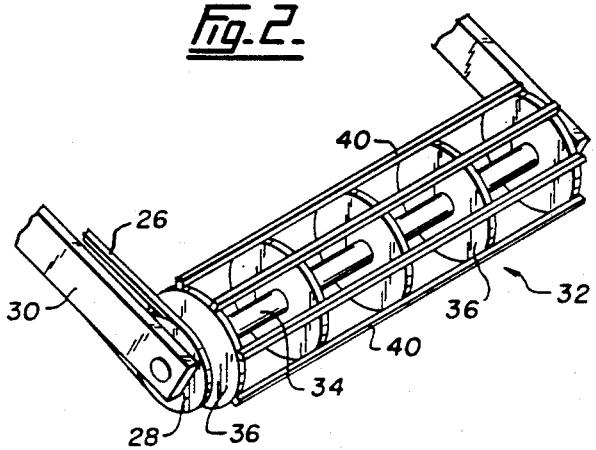
FIG. 2 is a detail of the apparatus of FIG. 1.

As in the U.S. Pat. No. 3,596,577 the apparatus of the present invention includes a carrier 10 of conventional design, the majority of the details of which are not shown. Its function is to carry the apparatus of the present invention over the surface 12 to be treated. It may be driven by its own engine or towed. As in my U.S. Pat. No. 3,596,577 there is an engine 14 having an output sprocket 16 that drives a chain 18. That chain 18 drives a second sprocket 20 and the second sprocket 20, in turn, drives chain 22 to drive third sprocket 24. A belt drive 26 extends from the third sprocket to drive a sheave 28. The sheave 28 is mounted to the vehicle 10 by trailing arms 30. Sheave 28 is attached to a reel 32 that comprises a central shaft 34 to which circular discs 36 are attached. There is a spray bar 38 fed by a conduit 40 extending from tank 42. A pump, not shown, may be mounted in the tank 42 to force liquid along the conduit 41 to the spray bar 38. The spray bar 38 directs liquid under pressure to that part of face 12 that is being cut by the rotating reel 32.

Figure 3:
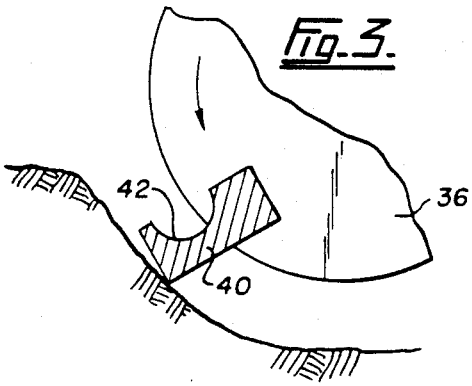
FIG. 3 is a detail, partially in section, showing a preferred embodiment of the present invention.
Figure 4:
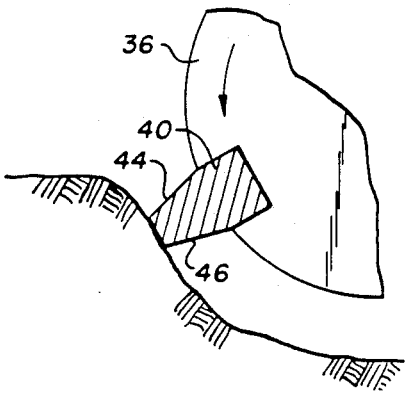
FIG. 4 is a view similar to FIG. 3 showing a further preferred embodiment.

As in the above U.S. Pat. No. 3,596,577, the reel 32 is formed with bars 40 and the characteristics of the present invention are illustrated in FIGS. 3 and 4. The bars 40 in the apparatus of the present invention are provided with means to induce areas of reduced pressure on the trailing face of each bar 40, trailing that is with regard to the direction of rotation of the reel, and thus of the bar, to improve the distribution of the liquid as it is applied.

In the embodiment of FIG. 3 the cutter bar has a recess 42 of generally semi-circular cross-section in the trailing face. In the embodiment of FIG. 4 the trailing face is cut away at 44 so that the bar narrows with distance from the periphery of the reel 32. Figure 4 shows a preferred embodiment of this aspect of the invention in which the leading edge of the bar is also cut away at 46 or relieved so that the bar 40 extending from the periphery of the reel 32 is of generally truncated triangular section.

As in U.S. Pat. No. 3,596,577 the trailing arms, belt drive and reel are mounted in a hood 46 to restrict the movement travelled by shaved surface particles.

Figure 5:
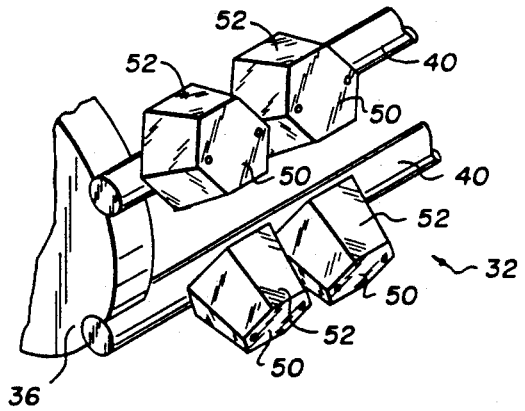
FIGS. 5 and 6 illustrate modifications of the apparatus of FIG. 4.

FIG. 5 is a detail illustrating a modification of the present invention. In the modification of FIG. 5 the reel 32 is formed with bars 40 but those are of simple circular cross section. In order to produce an area of reduced pressure bars 40 are formed with separate members 50 each formed in the manner of the bars 40 in FIG. 4 that is with a relieved trailing face 52. The members 50 may simply be bolted to the bars 40 or may be attached by welding. Similarly, the bars 40 may be attached to the reel either by welding or by bolting.

The members 50 are staggered relative to one another. Thus as the inclined side walls leave a gap in one row of members 50 that gap is aligned with a member 50 in the next row.

The convenience of the embodiment of FIG. 5 is that the members 50 may be formed symetrical about their center line and, when worn away, may be simply be reversed so that a new trailing face 52 is brought into use. Alternatively, the bar 40 can be pulled from the reel, turned over and reattached to bring a new series of cutting faces into contact with the surface as the reel rotates. Because of this particular feature it will be appreciated that the use of relieved faces, as shown in FIG. 4, is preferred to the recesses 42 of FIG. 3 and the relieved face embodiment shown in FIG. 4.

Figure 6:
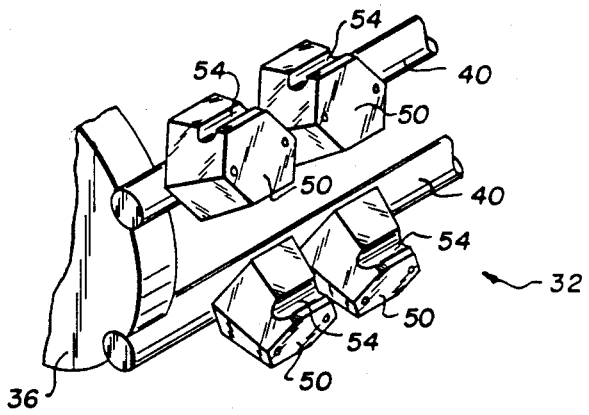

FIG. 6 shows an embodiment resembling that of FIG. 5 but members 50 are formed with recesses 54. This embodiment does not lend itself to reversal as well as the embodiment of FIG. 5.

The apparatus of the present invention is used precisely as in the apparatus of U.S. Pat. No. 3,596,577. As the carrier moves along the surface to be treated the motor 14 is started and the chain and belt drive used to rotate the reel 32. At the same time the reel 32 is lowered under the influence of a double acting hydraulic cylinder (not shown) and moved to the solid line position shown in FIG. 1. The cutter bar 40 then abrades the surface 12 over which the carrier is moved. The pump is started and liquid is sprayed at the surface as it is cut. This ensures that the additive can be used to stabilize the surface. The use of such additives is well known in the art.

The means to induce vacuum in the form of recesses on each reel bar and, in the embodiment of FIG. 4, relieved trailing faces, means the liquid spray is more effectively distributed along the length of the reel.

The reels 32 may be of the order of eight feet long.

The present invention provides improvements in the apparatus of U.S. Pat. No. 3,596,577. It is of a more general application. It is not useful merely in soil stabilization but, because of the improved additive distribution, can be used for treating surfaces in the far North by shaving and redistributing the top layer of the surface to provide a smooth surface on, for example, roads and runways.

I claim:

1. An apparatus for stabilizing a surface, the apparatus including a carrier arranged for movement over the surface to be stabilized, a reel mounted on the carrier for rotation about an axis of rotation transverse to the direction of movement of the carrier, the reel having a plurality of circumferentially spaced cutter bars that extend the length of the reel parallel to the axis of rotation, lifting means for lifting and lowering the reel relative to the surface the improvement comprising forming the trailing face of each cutter bar with means to produce a zone of reduced pressure at said trailing face as the cutter bar rotates.

2. An apparatus as claimed in claim 1 in which the trailing face of each cutter bar is formed with a longitudinal recess.

3. An apparatus as claimed in claim 2 in which the recess is generally semi-circular in section.

4. An apparatus as claimed in claim 1 in which the trailing face is cut away to narrow with distance from the reel.

5. An apparatus as claimed in claim 4 in which the leading face is also cut away so that the bar is of truncated triangular section with the base of the truncated triangle at the reel periphery.

6. An apparatus as claimed in claim 1 in which the cutter bar is formed with a plurality of separate members, each member being formed with means to produce a zone of reduced pressure at the trailing face.

7. An apparatus as claimed in claim 6 in which the separate members are welded onto the bar.

* * * * *